US005444963A

United States Patent [19]

Steingroever et al.

[11] Patent Number: 5,444,963

[45] Date of Patent: Aug. 29, 1995

[54] PROCESS AND EQUIPMENT FOR SHAPING CONTAINER SEALS

[75] Inventors: Erich Steingroever, Bonn; Udo Biedermann, Cologne, both of Germany

[73] Assignee: Magnet-Physik Dr. Steingroever GmbH, Germany

[21] Appl. No.: 208,231

[22] Filed: Mar. 10, 1994

[30] Foreign Application Priority Data

Mar. 11, 1993 [DE] Germany ..... 43 07 708.0
Mar. 11, 1993 [DE] Germany ..... 43 26 813.7

[51] Int. Cl.[6] ..... B67B 3/18

[52] U.S. Cl. ..... 53/488; 53/296; 53/DIG. 2; 53/331; 29/419.2

[58] Field of Search ..... 29/419.2; 72/707; 53/290, 296, 297, 329, 329.2, 485, 488, 331, DIG. 2

[56] References Cited

U.S. PATENT DOCUMENTS

| | | | |
|---|---|---|---|
| 2,976,907 | 3/1961 | Harvey et al. | 153/10 |
| 3,336,728 | 8/1967 | Monaco | 53/334 |
| 3,426,564 | 2/1969 | Jansen et al. | 29/419.2 |
| 3,548,140 | 12/1970 | O'Neill | 53/478 |
| 3,706,176 | 12/1972 | Leatherman | 53/329.2 |
| 3,713,268 | 1/1973 | Gess | 53/334 |
| 3,775,944 | 12/1973 | Roberts | 53/334 |
| 3,808,074 | 4/1974 | Smith et al. | 156/69 |
| 3,842,574 | 10/1974 | Dickey | 53/42 |
| 4,059,882 | 11/1977 | Wunder | 29/419.2 |
| 4,129,846 | 12/1978 | Yablochikov | 336/84 |
| 5,111,635 | 5/1992 | Neber | 53/334 |

OTHER PUBLICATIONS

Brower, Magnetic Pulse Form, May 29, 1962, All pages Jan 8, 1962.

*Primary Examiner*—John Sipos
*Assistant Examiner*—Gene L. Kim
*Attorney, Agent, or Firm*—Harold Gell

[57] ABSTRACT

A process and equipment for shaping seals for containers with an electromagnetic pulse. The pulse is generated by a current pulse coil positioned around the seal and energized by the discharge current of a condenser. The process and the equipment are particularly suited for sealing containers for milk and dairy products and also for other beverages and products.

29 Claims, 3 Drawing Sheets

PROCESS AND EQUIPMENT FOR SHAPING CONTAINER SEALS

TECHNICAL FIELD

This invention relates to a process for shaping container seals (closures or caps) consisting of an electrically conducting metal, especially aluminum or a light-metal alloy.

BACKGROUND OF THE INVENTION

It is known that one can seal containers with metal caps that are folded mechanically upon or around the container opening or that are crimped on. This known process does not result in a reliable seal, for example, of a beverage bottle, because of the folds. This is why, to make the seal tight, there is an additional sealing or gluing on the container edge that, on the one hand, is expensive and, on the other hand, causes problems during the recycling of the metal because it burns up as the metal is melted down and thus releases toxic or corroding gases.

SUMMARY OF THE INVENTION

The purpose of the invention is to provide a process and equipment, suitable for implementing the process, by which means it is possible in a technically perfect manner to close up containers, such as, especially, milk bottles and other suitable containers, using container seals made of an electrically conducting metal, without the use of any mechanical tools.

OBJECTIVES OF THE INVENTION

A primary objective of the invention is to provide a process for applying container seals (closures or caps) of metal by deforming or shaping them, characterized by subjecting them to an electromagnetic pulse that acts on the seal.

A primary objective of the invention is to provide a process for applying container seals (closures or caps) of magnetic field responsive material by deforming or shaping them, characterized by subjecting them to an electromagnetic pulse that acts on the seal.

Another objective of the invention is to provide a process for applying container seals (closures or caps) of metal characterized in that they are shaped by an electromagnetic pulse that acts on the rim of the seal.

Another objective of the invention is to provide a process for shaping container seals (closures or caps) characterized in that a deforming electromagnetic pulse is generated with a current coil by way of the discharge current of a capacitor.

Another objective of the invention is to provide a process for deforming container seals (closures or caps) characterized in that the discharge of the capacitor takes place aperiodically, periodically, or as a sine half-wave.

Another objective of the invention is to provide a process for deforming container seals (closures or caps) characterized in that it consists of a pulse coil and a pulse generator.

Another objective of the invention is to provide a process for deforming container seals (closures or caps) characterized in that the pulse coil tightly surrounds the rim of the closure.

Another objective of the invention is to provide a process for deforming container seals (closures or caps) characterized in that the pulse coil is connected via a pulse transformer to the pulse generator.

Another objective of the invention is to provide a process for deforming container seals (closures or caps) characterized in that a back stop or brace for the top of the closure is connected to the pulse coil assembly.

Another objective of the invention is to provide a process for deforming container seals (closures or caps) characterized in that the closure to be deformed is located in the homogeneous part of the coil field.

Another objective of the invention is to provide a process for deforming container seals (closures or caps) characterized for closing milk and milk products and beverage containers.

Another objective of the invention is to provide a process for deforming container seals (closures or caps) characterized by a conical tapering starting from the opening.

SUMMARY OF THE INVENTION

The problem set forth in "BACKGROUND OF THE INVENTION" is solved according to the invention by means of an electromagnetic pulse that acts on the seal.

The process according to the invention offers the advantage that the seal—by means of the electromagnetic pulse acting upon it—is tightly shaped around the container nozzle or bottle neck, without any material friction or without any mechanical damage, so that no additional sealing means are required for a tight container seal.

It is particularly advantageous for shaping the seal when the electromagnetic pulse acts on the edge on the preferably thin-walled seal. The electromagnetic pulse is generated by means of a current coil due to the discharge current of a condenser. The condenser can be discharged aperiodically, periodically, or as a sine half-wave.

In closing containers, the seal to be shaped is preferably arranged in the approximately homogenous part of the magnetic field of a current coil.

An instrument to perform the process according to the invention is characterized in that it consists of a current pulse coil and a pulse generator. The current pulse coil envelopes the edge of the seal to be shaped tightly. It is connected to the post generator, if necessary, via a pulse transformer.

There is a danger—especially when one uses thin aluminum foils or foils made up of a light-metal alloy—that the seal, upon closing, will be made to bulge upward in its middle part as a result of the electromagnetic pulse. This can be prevented in a simple manner in that the current pulse coil is connected with a brace for the seal that best consist of copper.

A particularly tight and reliable pull of the seal on the container opening furthermore can be attained by inserting the container, with a conical taper of the edge or the container neck from the container opening, to apply the process according to the invention.

BRIEF DESCRIPTION OF THE DRAWINGS

The diagrams illustrate preferred practical examples of the invention.

DETAILED DESCRIPTION OF THE INVENTION

Figure 1:
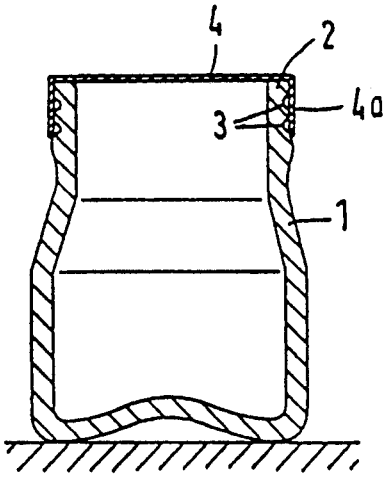
FIG. 1 is a profile through a beverage bottle or a container for dairy products or the like with a seal placed upon the bottle neck but not yet shaped.

FIG. 1 shows a container or a beverage bottle 1 with a container edge or container neck 2 that reveals one or several grooves 3 to receive a shaped seal (closure or cap) 4. Seal 4 has a cylindrical edge 4*a* and is not in shaped in FIG. 1.

Figure 2:
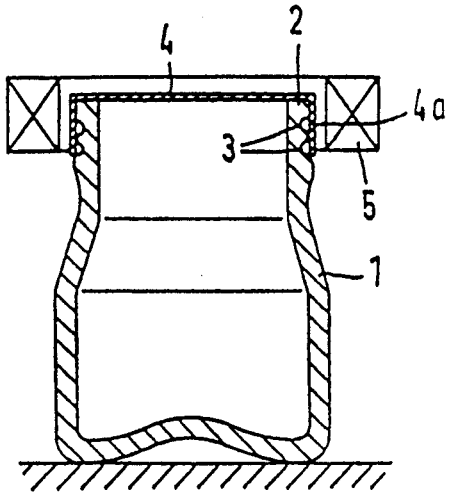
FIG. 2 is a profile through the beverage bottle or the container in FIG. 1, with an electromagnetic pulse coil that surrounds the seal that is loosely placed on the container.

In FIG. 2, seal 4, loosely placed on the container or beverage bottle 1, is surrounded by an electromagnetic current pulse coil 5.

Figure 3:
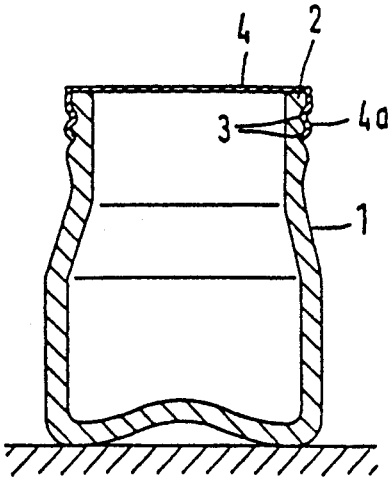
FIG. 3 shows the tightly-closing seal shaped upon the container neck, after a high electromagnetic pulse has acted on the seal from the pulse coil.

FIG. 3 shows the tightly closing seal 4 that is shaped upon container edge or container neck 2, after a high electromagnetic pulse has acted on seal 4 from the current pulse coil.

Figure 4:
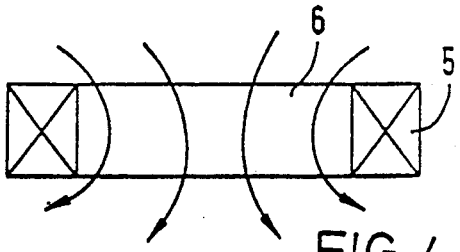
FIG. 4 is a lateral profile through the pulse coil with the course of the magnetic field line, indicated by arrows.
Figure 5:
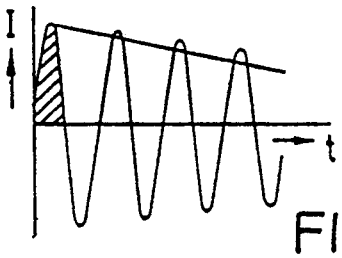
FIG. 5 illustrates the electromagnetic pulse in the form of a current-time diagram.

FIG. 4 is a current pulse coil 5 that has a passage opening 6, corresponding to the shape of container neck 2. It can be round or also rectangular or polygonal.

The electromagnetic pulse can be transmitted aperiodically or periodically or also as a sine wave.

The electromagnetic pulse is generated by the rapid discharge of an electrical condenser. Pulse induces a high current in seal 4 and that current seeks to bypass the magnetic field of the pulse and thus exerts a radial force on edge 4*a* of seal 4 that leads to the shaping of the edge.

Figure 6:
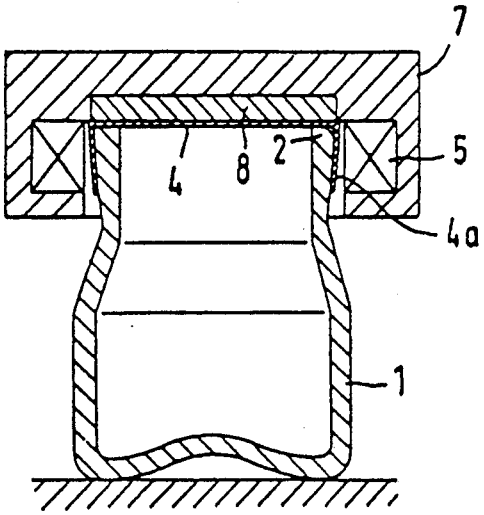
FIG. 6 is a profile through a beverage bottle or a similar container with a coil holder and pressure plate placed upon the bottle or container neck.

A force is also exerted on the bottom of seal 4 during the pulse. FIG. 6 shows how this force can be intercepted by a pressure plate or brace holder 8 that, for example, is connected with a coil holder 7 and best consists of copper or aluminum, in order to shape the magnetic field by means of the eddy current formation (skin effect).

Figure 9:
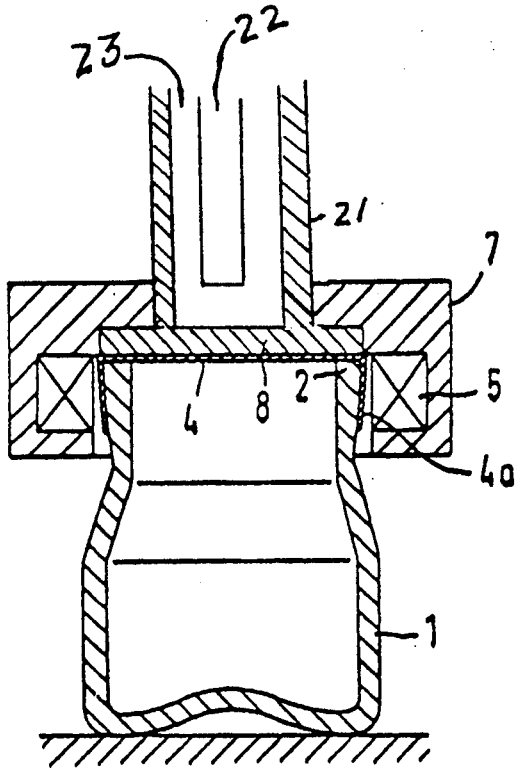
FIG. 9 is a profile through a beverage bottle or a similar container with a coil holder and heat exchange pressure plate using a liquid heat exchange medium placed upon the bottle or container neck.

The operation may be enhanced by heating and/or cooling the pressure plate with a heat exchanger 21 as illustrated in FIG. 9. In this embodiment, a liquid heat transfer fluid flow toward the pressure plate through the inner tube 23 and returns to its source via the surrounding chamber 24.

Figure 10:
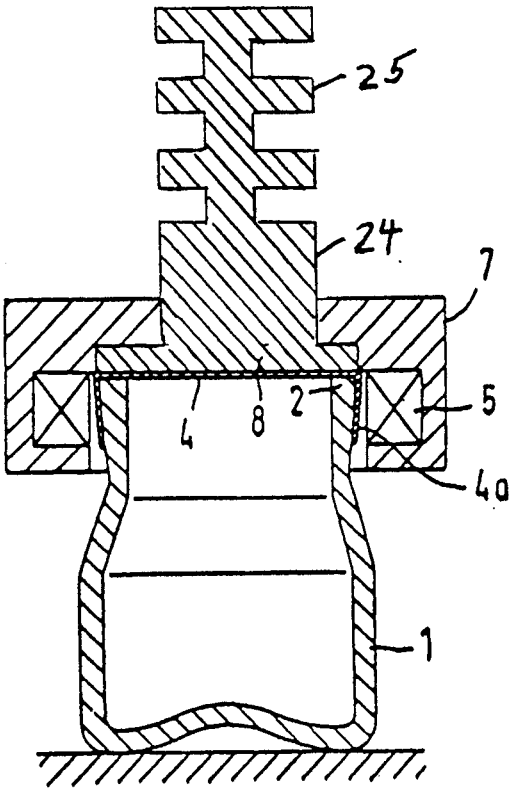
FIG. 10 is a profile through a beverage bottle or a similar container with a coil holder and heat exchange pressure plate using air as the heat exchange medium placed upon the bottle or container neck.

In the embodiment illustrated in FIG. 10, the heat exchange is accomplished by a heat sink 24 fabricated from a material such as copper with heat exchange fins 25 extending into a flowing air stream.

In the practical example shown in FIG. 6, the container edge or container neck 2 is slightly conical, illustrated as tapering from the container opening; this causes a particularly tight seal if the initially cylindrical edge 4*a* of seal 4 is shaped and comes to rest tightly against the bottle or container neck 2.

The process and equipment to perform the process according to the invention are particularly suitable for sealing the lids or seals 4 that are made of light metal such as aluminum and other electrically conducting metals or magnetic field responsive materials and that are used on containers for milk and dairy products and other beverages.

Figure 7:
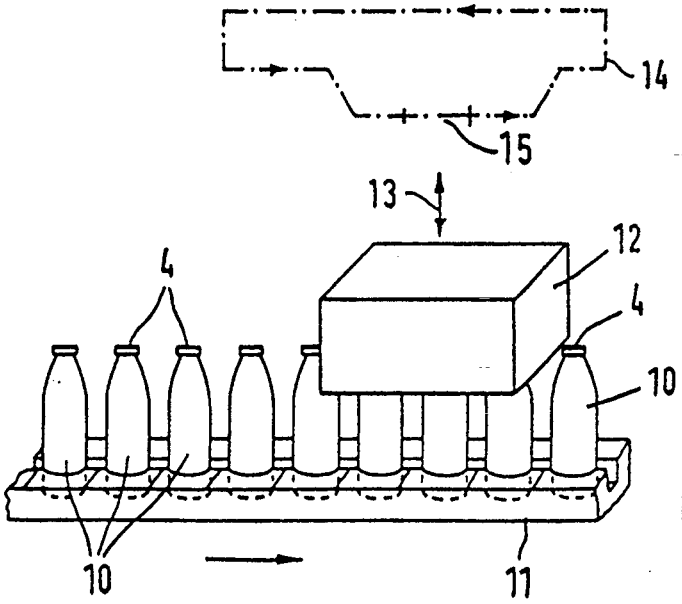
FIG. 7 is a pictorial illustration of the essential parts of a mechanism for the simultaneous closing of several milk or beverage bottles moving, one behind the other, on a transport device.
Figure 8:
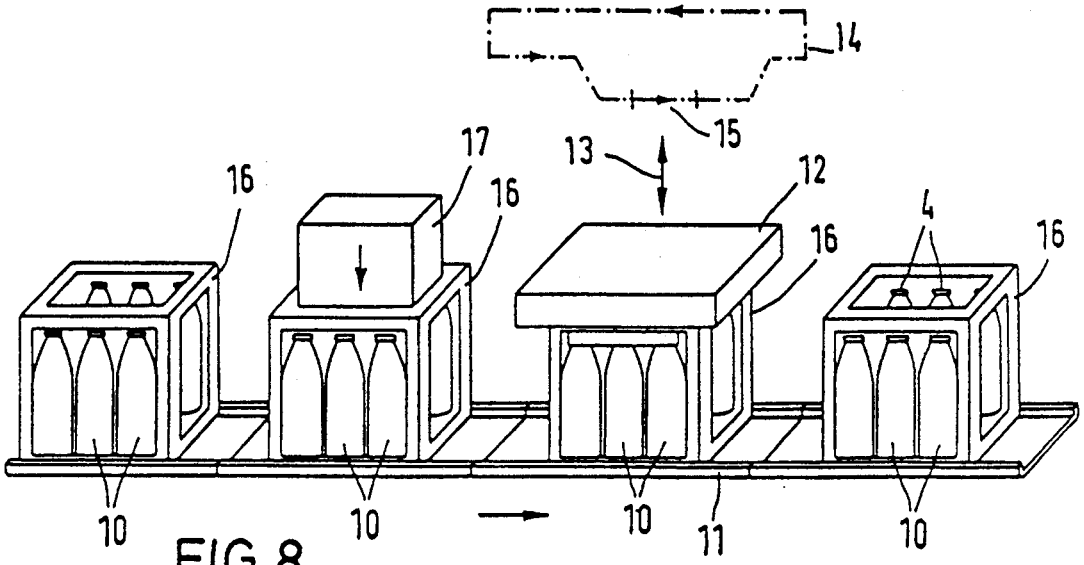
FIG. 8 is a pictorial illustration of a transport device with a device—arranged over it—for the simultaneous closing of several milk bottles or the like that stand next to each other in transport crates.

Two such devices are shown in FIGS. 7 and 8; FIG. 7, milk bottles 10, with loosely placed seals 4, arrive standing one behind the other on a conveyor belt 11 and several of them, at one time, are closed up simultaneously by a shaping device 12.

Shaping device 12 can be moved up and down in the direction of double arrow 13 and has several current pulse coils 5 arranged in series behind each other. After lowering upon container or bottle necks 2, it is moved along, with conveyor belt 11, for each shaping step, in order then, in accordance with the motion diagram 14, once again to be moved back into the starting position to close up the following bottles. The shaping here is always done in area 15 of this motion diagram.

This also applies to the illustration in FIG. 8, for several milk bottles 10 stand next to each other in transport crates 16 and, via conveyor belt 11, are moved under dispenser 7 which is arranged for several seals 4, each time; all of them are then simultaneously closed up in the manner described by the shaping device 12.

While preferred embodiments of this invention have been illustrated and described, variations and modifications may be apparent to those skilled in the art. Therefore, we do not wish to be limited thereto and ask that the scope and breadth of this invention be determined from the claims which follow rather than the above description.

What is claimed is:

1. A process for shaping a container seal of the type including closures and caps made of a magnetic field responsive material, including the steps of:

bracing the top of said seal with a plate; and applying a magnetic force shaped by said plate and generated by an electromagnetic pulse that acts on said seal by shaping said seal to conform to the exterior surface of a container neck.

2. A process for shaping a container seal of the type including closures and caps made of an electrically responsive material, including the steps of: bracing the top of said seal with a pressure applying plate of electrically conducting material; and applying a magnetic force shaped by said plate and generated by an electromagnetic pulse that acts on said seal by shaping said seal to conform to the exterior surface of a container neck.

3. A process according to claim 1, characterized in that the electromagnetic pulse works on the edge of said seal.

4. A process according to claim 1, characterized in that the electromagnetic pulse is generated with a current pulse coil by the discharge current of a condenser.

5. A process according to claim 4, characterized in that the condenser is discharged aperiodically.

6. A process according to claim 4, characterized in that the condenser is discharged periodically.

7. A process according to claim 4, characterized in that the condenser is discharged as a sine half-wave.

8. A process according to claim 1, characterized in that said seal to be shaped is arranged in the approximately homogenous part of the magnetic field of a current pulse coil.

9. A process according to claim 1, characterized in that it is used to close containers for milk and dairy products.

10. A process as defined by claim 1 wherein said container neck is characterized by a conical taper of said container neck away from the container opening.

11. A process according to claim 3, characterized in that the electromagnetic pulse is generated with a current pulse coil by the discharge current of a condenser.

12. A process according to claim 1, characterized in that the condenser is discharged aperiodically.

13. A process according to claim 1, characterized in that the condenser is discharged periodically.

14. A process according to claim 1, characterized in that the condenser is discharged as a sine half-wave.

15. A process according to claim 1, including the step of affecting the temperature of said seal by a heat exchanger attached to said plate.

16. A process according to claim 15 including the step of affecting the temperature of said heat exchanger by circulating a fluid through said heat exchanger.

17. A process according to claim 15 including the step of affecting the temperature of said heat exchanger by forcing air over heat exchange fins of said heat exchanger.

18. A process as defined in claim 15 wherein said step of affecting the temperature of said seal includes the steps of heating said seal.

19. A process as defined in claim 15 wherein said step of affecting the temperature of said seal includes the steps of cooling said seal.

20. An apparatus for shaping a container seal of the type including closures and caps made of a magnetic field responsive material, comprising:

a current pulse coil for generating an electromagnetic pulse;

an electrically conductive plate for shaping the field of force generated by said electromagnetic pulse for shaping said seal; and a pulse generator for driving said current pulse coil.

21. An apparatus for shaping a container seal of the type including closures and caps made of an electrically conducting metal, comprising:

a plate for bracing the top of said seal;

a current pulse coil for generating an electromagnetic pulse for shaping said seal by magnetic force shaped by said plate; and a pulse generator for driving said current pulse coil.

22. An apparatus as defined in claim 21, wherein said plate includes a heat exchanger.

23. An apparatus as defined by claim 21 wherein said heat exchanger includes conduit means for circulating a heat transport fluid.

24. An apparatus as defined by claim 21 wherein said heat exchanger includes fins for enhancing heat exchange with air flowing over said fins.

25. An apparatus as defined by claim 21, characterized in that said current pulse coil is dimensioned to tightly encloses the edge of said seal which is to be shaped.

26. An apparatus as defined by claim 21, characterized in that said current pulse coil is connected to said pulse generator via a pulse transformer.

27. An apparatus as defined by claim 26, characterized in that said plate is made of copper.

28. An apparatus as defined by claim 21 wherein said current pulse coil comprises a means for shaping said seal to conform to the exterior surface of a container neck.

29. An apparatus as defined by claim 28 wherein said container neck exterior surface is a conical taper away from the container opening.

* * * * *

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 4,

Claim 1. A process for shaping a container seal of the type including closures and caps made of a magnetic field responsive material, including the steps of:

bracing the top of said seal with an electrically conductive plate;

applying a magnetic field generated by an electromagnetic pulse that acts on said seal; and shaping said magnetic field by said plate to enhance the ability of said magnetic field to conform said seal to the exterior surface of a container neck and minimize the perpendicular force of said magnetic field on the top of said seal.

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 4,

Claim 2. A process for shaping a container seal of the type including closures and caps made of an electrically responsive material, including the steps of:

bracing the top of said seal with a pressure applying plate of electrically conducting material;

applying a magnetic force generated by an electromagnetic pulse to said seal to conform said seal to the exterior surface of a container neck; and enhancing the effects of said magnetic force by shaping said magnetic field with said pressure applying plate.

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 6,

Claim 20. An apparatus for shaping a container seal of the type including closures and caps made of a magnetic field responsive material, comprising:

a current pulse coil for generating an electromagnetic pulse;

an electrically conductive plate for bracing the top of said container seal and shaping the field generated by said electromagnetic pulse for enhancing the effects of the magnetic force shaping said seal about a container; and a pulse generator for driving said current pulse coil.

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 6,

Claim 21. An apparatus for shaping a container seal of the type including closures and caps made of an electrically conducting metal, comprising:

a plate for bracing the top of said seal;

said plate fabricated from electrically conducting by means of eddy current formation to thereby alter the shape of a field of magnetic force and reduce the adverse effects of magnetic field forces perpendicular to the top of said seal;

a current pulse coil for generating an

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

electromagnetic field in the form of a pulse of magnetic force having an effective shape altered by said plate for shaping said seal to conform to a container; and a pulse generator for driving said current pulse coil.

Signed and Sealed this

Twenty-eighth Day of May, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-inoentified patent and that said Letters Patent is hereby corrected as shown below:

Column 4,

Claim 1. A process for shaping a container seal of the type including closures and caps made of a magnetic field responsive material, including the steps of:

bracing the top of said seal with an electrically conductive plate;

applying a magnetic field generated by an electromagnetic pulse that acts on said seal; and shaping said magnetic field by said plate to enhance the ability of said magnetic field to conform said seal to the exterior surface of a container neck and minimize the perpendicular force of said magnetic field on the top of said seal.

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 4,

Claim 2. A process for shaping a container seal of the type including closures and caps made of an electrically responsive material, including the steps of:

bracing the top of said seal with a pressure applying plate of electrically conducting material;

applying a magnetic force generated by an electromagnetic pulse to said seal to conform said seal to the exterior surface of a container neck; and enhancing the effects of said magnetic force by shaping said magnetic field with said pressure applying plate.

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 6,

Claim 20. An apparatus for shaping a container seal of the type including closures and caps made of a magnetic field responsive material, comprising:

a current pulse coil for generating an electromagnetic pulse;

an electrically conductive plate for bracing the top of said container seal and shaping the field generated by said electromagnetic pulse for enhancing the effects of the magnetic force shaping said seal about a container; and a pulse generator for driving said current pulse coil.

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

Column 6,

Claim 21. An apparatus for shaping a container seal of the type including closures and caps made of an electrically conducting metal, comprising:

a plate for bracing the top of said seal;

said plate fabricated from electrically conducting material for altering an electromagnetic field shape by means of eddy current formation to thereby alter the shape of a field of magnetic force and reduce the adverse effects of magnetic field forces perpendicular to the top of said seal;

a current pulse coil for generating an

UNITED STATES PATENT AND TRADEMARK OFFICE

CERTIFICATE OF CORRECTION

PATENT NO. : 5,444,963

DATED : Aug. 29, 1995

INVENTOR(S) : Erich Steingroever, et al

It is certified that error appears in the above-indentified patent and that said Letters Patent is hereby corrected as shown below:

electromagnetic field in the form of a pulse of magnetic force having an effective shape altered by said plate for shaping said seal to conform to a container; and a pulse generator for driving said current pulse coil.

This certificate supersedes Certificate of Correction issued May 28, 1996.

Signed and Sealed this

Sixth Day of August, 1996

Bruce Lehman

*Attest:*

BRUCE LEHMAN

*Attesting Officer*

*Commissioner of Patents and Trademarks*